US008529410B2

(12) United States Patent
Chen

(10) Patent No.: US 8,529,410 B2
(45) Date of Patent: Sep. 10, 2013

(54) MULTI-MODE EXERCISE BIKE

(75) Inventor: Chao-Chuan Chen, Taichung (TW)

(73) Assignee: Zhejiang Everbright Industry, Inc., Ningbo (CN)

( * ) Notice: Subject to any disclaimer, the term of this patent is extended or adjusted under 35 U.S.C. 154(b) by 343 days.

(21) Appl. No.: 13/105,907

(22) Filed: May 12, 2011

(65) Prior Publication Data

US 2012/0289380 A1 Nov. 15, 2012

(51) Int. Cl.
*A63B 21/00* (2006.01)
*A63B 22/00* (2006.01)

(52) U.S. Cl.
USPC ..... 482/52; 482/51; 482/57

(58) Field of Classification Search
USPC ..... 482/51–53, 57–65, 79–80
See application file for complete search history.

(56) References Cited

U.S. PATENT DOCUMENTS

| | | | | | |
|---|---|---|---|---|---|
| 5,611,756 | A * | 3/1997 | Miller | 482/52 |
| 5,795,268 | A * | 8/1998 | Husted | 482/51 |
| 5,910,072 | A * | 6/1999 | Rawls et al. | 482/51 |
| 5,967,944 | A * | 10/1999 | Vittone et al. | 482/52 |
| 6,004,244 | A * | 12/1999 | Simonson | 482/52 |
| 6,036,622 | A * | 3/2000 | Gordon | 482/51 |
| 6,045,487 | A * | 4/2000 | Miller | 482/52 |
| 7,828,698 | B2 * | 11/2010 | Rodgers, Jr. | 482/52 |
| 8,092,351 | B1 * | 1/2012 | Rodgers, Jr. | 482/52 |
| 8,317,663 | B2 * | 11/2012 | Stewart et al. | 482/52 |

* cited by examiner

*Primary Examiner* — Stephen Crow

(57) ABSTRACT

A multi-mode exercise device includes a main body having two supporting arm assemblies symmetrically mounted on two sides thereof. Each supporting arm assembly has four arms. The four arms of each supporting assembly are pivotally connected with each other via five pivot joints. The main body further has a guiding wheel set, a rotating disc and two connecting rods. Therefore, a user could step on pedals along vertical direction, parallel direction or circular direction selectively.

5 Claims, 6 Drawing Sheets

MULTI-MODE EXERCISE BIKE

BACKGROUND OF THE INVENTION

1. Field of the Invention

The present invention relates to an exercise bike, and more particularly to an exercise bike which provides multiple track modes.

2. Description of Related Art

A conventional exercise bike includes a main body having a transmission mechanism mounted in a parallel part thereof, a unidirectional swing arm clutch mounted thereon for controlling a rotation of a wheel, and a damping generator mounted thereon. A four-connection rod mechanism is operated with the transmission mechanism. A spring-restored mechanism is operated with the four-connection rod mechanism. The main body has a handlebar disposed on a vertical part thereof and an operational panel mounted on the vertical part thereof, and a liquid crystal display screen disposed on the panel thereof. The wheel is rotated by a connection of pedals, gears, one-way bearings and connection rods. An idle damping is provided for adjusting a tension of the wheel for providing different users.

The conventional exercise bike only provides a single exercise mode. A user feels boring, tired in the single exercise mode after long time using, such that the exercise effect will be decreased.

The present invention has arisen to mitigate and/or obviate the disadvantages of the conventional exercise bike.

SUMMARY OF THE INVENTION

The main objective of the present invention is to provide an improved exercise bike, and more particular to a multi-mode exercise bike.

To achieve the objective, the multi-mode exercise bike in accordance with the present invention includes a main body. The main body has two supporting arm assemblies symmetrically mounted on two sides thereof. Each supporting arm assembly comprises a first arm having one end pivotally connected with the main body, a second arm having one end pivotally connected with the main body, a third arm having one end pivotally connected with the other end of the first arm, and a fourth arm having one end pivotally connected with the other end of the third arm and the other end pivotally connected with the other end of the second arm. The first arm has a first jointer located between the main body and the first arm. The second arm has a second jointer located between the main body and the second arm. The second arm and the first arm are arranged in a crisscross manner without directly contacting to each other. The second jointer positioned lower than the first jointer. The third arm has a third jointer located between the third arm and the first arm. The third arm has a pedal mounted thereon. The fourth arm has a fourth jointer located between the third arm and the fourth arm. The fourth jointer is positioned adjacent to the pedal of third arm. A fifth jointer is located between the fourth arm and the second arm. The main body has a guiding wheel set mounted thereon for guiding the second arm swinging as a pivot of the second jointer. The guiding wheel set includes a rotating disc and two connecting rods respectively connected with two sides of the rotating disc. The two connecting rods are respectively connected with the two supporting arm assemblies. Each connecting rod has one end eccentrically pivotally connected with the rotating disc and the other end pivotally connected with a middle section of the second arm located between the second jointer and the fifth jointer.

Further, each first arm has a connector extending from the first jointer. The main body has a second guiding wheel set mounted therein for guiding the first arm reciprocatingly swinging as the pivot of the first jointer. The second guiding wheel set includes a second rotating disc and two second connecting rods respectively connected with two sides of the second rotating disc. Each second connecting rod has one end eccentrically pivotally connected with the second rotating disc and the other end pivotally connected with the connector.

Further, the main body has two set of damping mechanisms respectively relatively connected with the guiding wheel set and the second guiding wheel set. Each damping mechanism has a idle wheel connected with the rotating disc/second rotating disc and a magnet unit mounted on the idle wheel for controlling a damping force of the idle wheel.

Further, the first arm has a handle extending from the first jointer. The handle is pivotable as the pivot of the first jointer.

Further, the two pedals of the two third arms are faced to each other.

Further benefits and advantages of the present invention will become apparent after a careful reading of the detailed description with appropriate reference to the accompanying drawings.

DETAILED DESCRIPTION OF THE INVENTION

Figure 1:
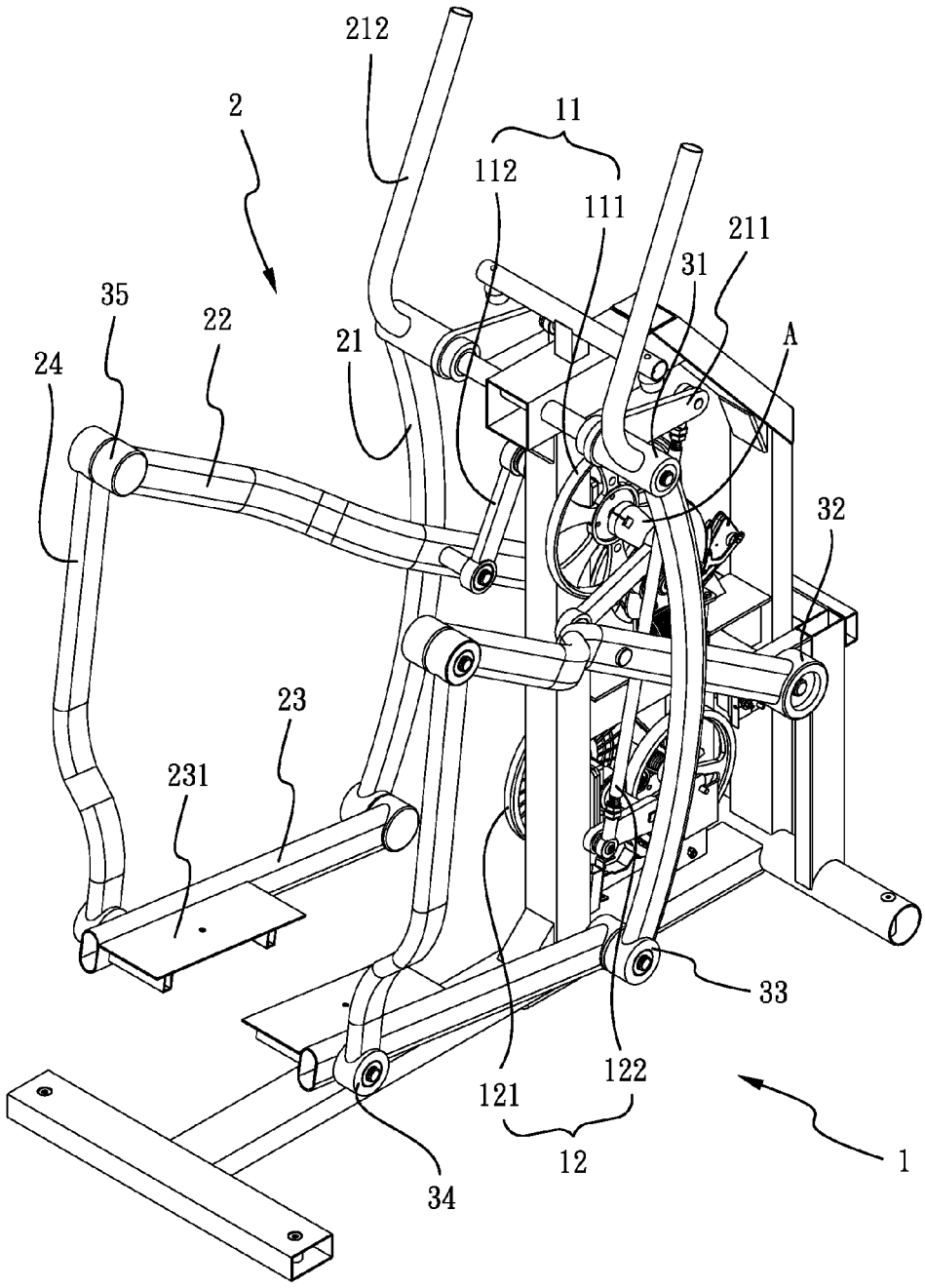
FIG. 1 is a perspective view of a multi-mode exercise bike in accordance with the present invention.

Referring to the drawings and initially to FIGS. 1-6, a multi-mode exercise bike in accordance with the present invention comprises a main body 1. The main body 1 has two supporting arm assemblies 2 symmetrically mounted on two sides thereof. Each supporting arm assembly 2 comprises a first arm 21 having one end pivotally connected with the main body 1, a second arm 22 having one end pivotally connected with the main body 1, a third arm 23 having one end pivotally connected with the other end of the first arm 21, and a fourth arm 24 having one end pivotally connected with the other end of the third arm 23 and the other end pivotally connected with the other end of the second arm 22.

The first arm 21 has a first jointer, also called a first pivot joint 31 located between the main body 1 and the first arm 21.

The second arm 22 has a second jointer, also called a second pivot joint 32 located between the main body 1 and the second arm 22. The second arm 22 and the first arm 21 are arranged in a crisscross manner without directly contacting to each other. The second jointer 32 positioned lower than the first jointer 31.

The third arm 23 has a third jointer, also called a third pivot joint 33 located between the third arm 23 and the first arm 21. The third arm 23 has a pedal 231 mounted thereon.

The fourth arm 24 has a fourth jointer, also called a fourth pivot joint 34 located between the third arm 23 and the fourth arm 24. The fourth jointer 34 is positioned adjacent to the pedal 231 of third arm 23. A fifth jointer, also called a fifth pivot joint 35 is located between the fourth arm 24 and the second arm 22.

The main body 1 has a guiding wheel set 11 mounted thereon for guiding the second arm 22 swinging as a pivot of the second jointer 32. The guiding wheel set 11 includes a rotating disc 111 and two connecting rods 112 respectively connected with two sides of the rotating disc 111. The two connecting rods 112 are respectively connected with the two supporting arm assemblies 2. Each connecting rod 112 has one end eccentrically pivotally connected with the rotating disc 111 and the other end pivotally connected with a middle section of the second arm 22 located between the second jointer 32 and the fifth jointer 35.

Figure 4:
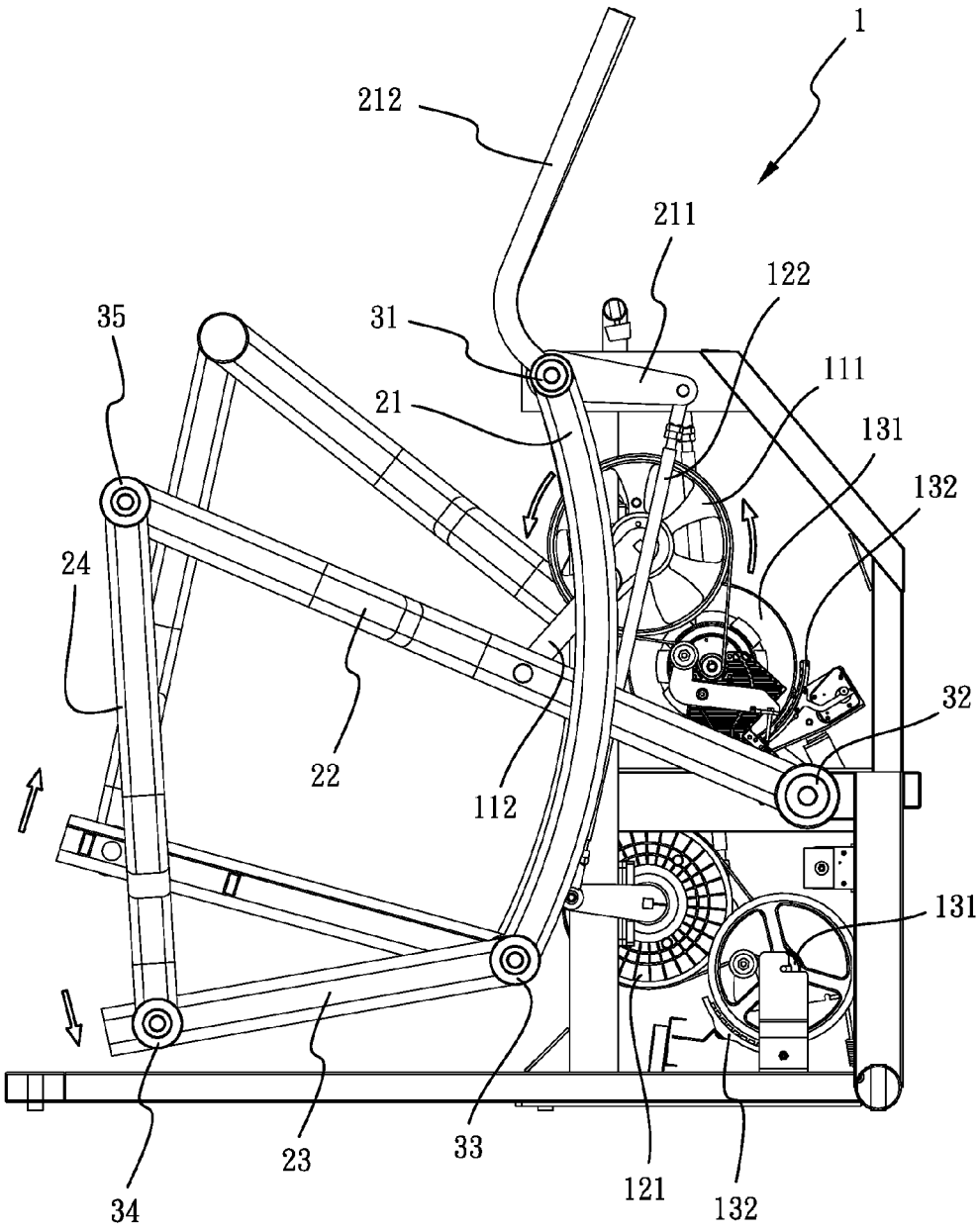
FIG. 4 is an operational view of the multi-mode exercise bike in accordance with the present invention in a vertical exercise mode.

Referring to FIG. 4, when a user alternatively steps on the pedals 231 along a vertical direction, the guiding wheel set 11 guides the second arm 22 reciprocatingly swinging up and down as the pivot of the second jointer 32. The fourth arm 24 pivotally pulls the third arm 23 such that the third arm 23 is swung up and down as the pivot of the third jointer 33.

Figure 5:
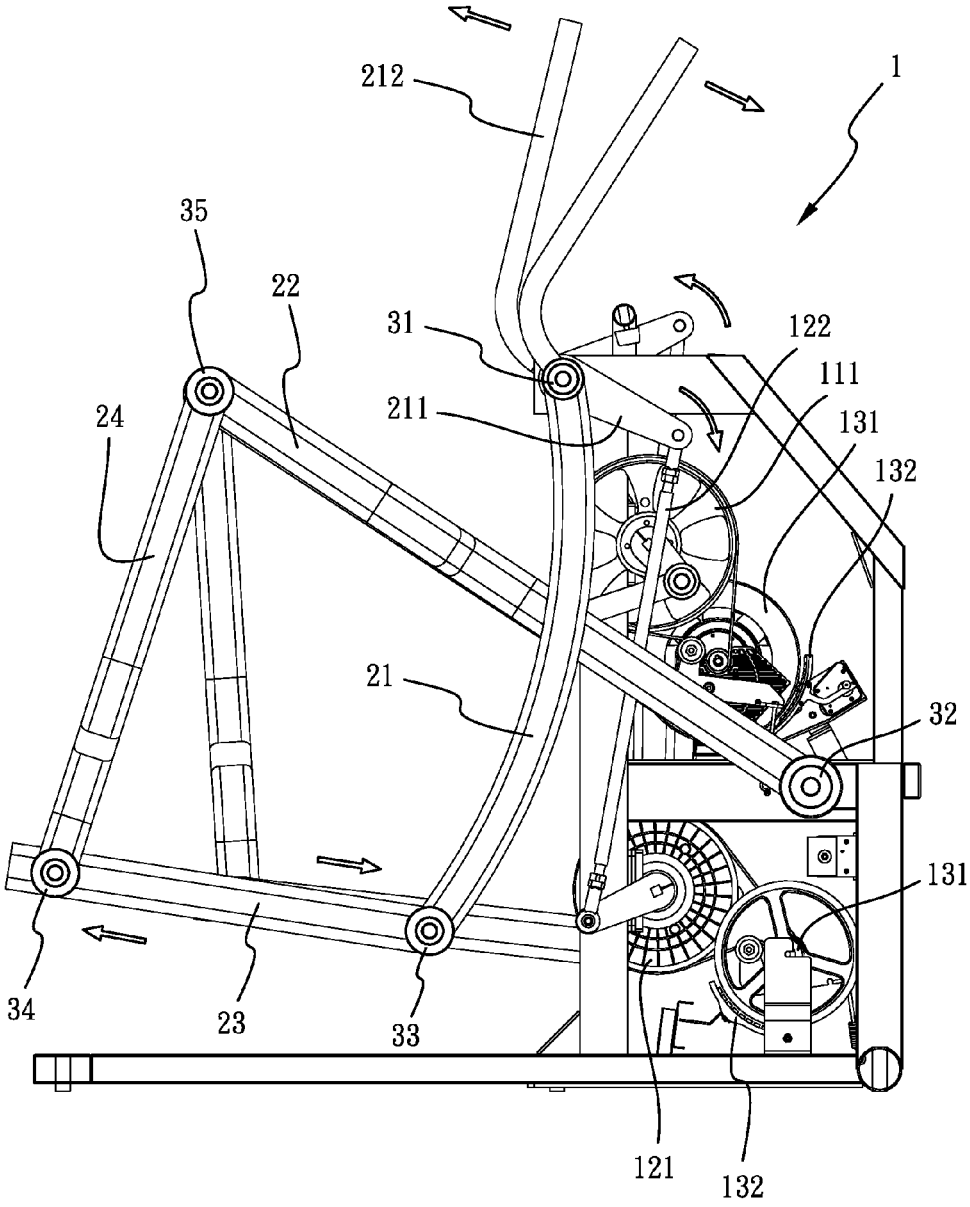
FIG. 5 is an operational view of the multi-mode exercise bike in accordance with the present invention in a parallel exercise mode.

Referring to FIG. 5, when the user alternatively steps on the pedals 231 along a parallel direction, the third arm 23 is suspended on the first arm 21 and the fourth arm 24 such that the third arm 23 is swung along the parallel direction as the pivots of the first jointer 31 and the fifth jointer 35.

Figure 6:
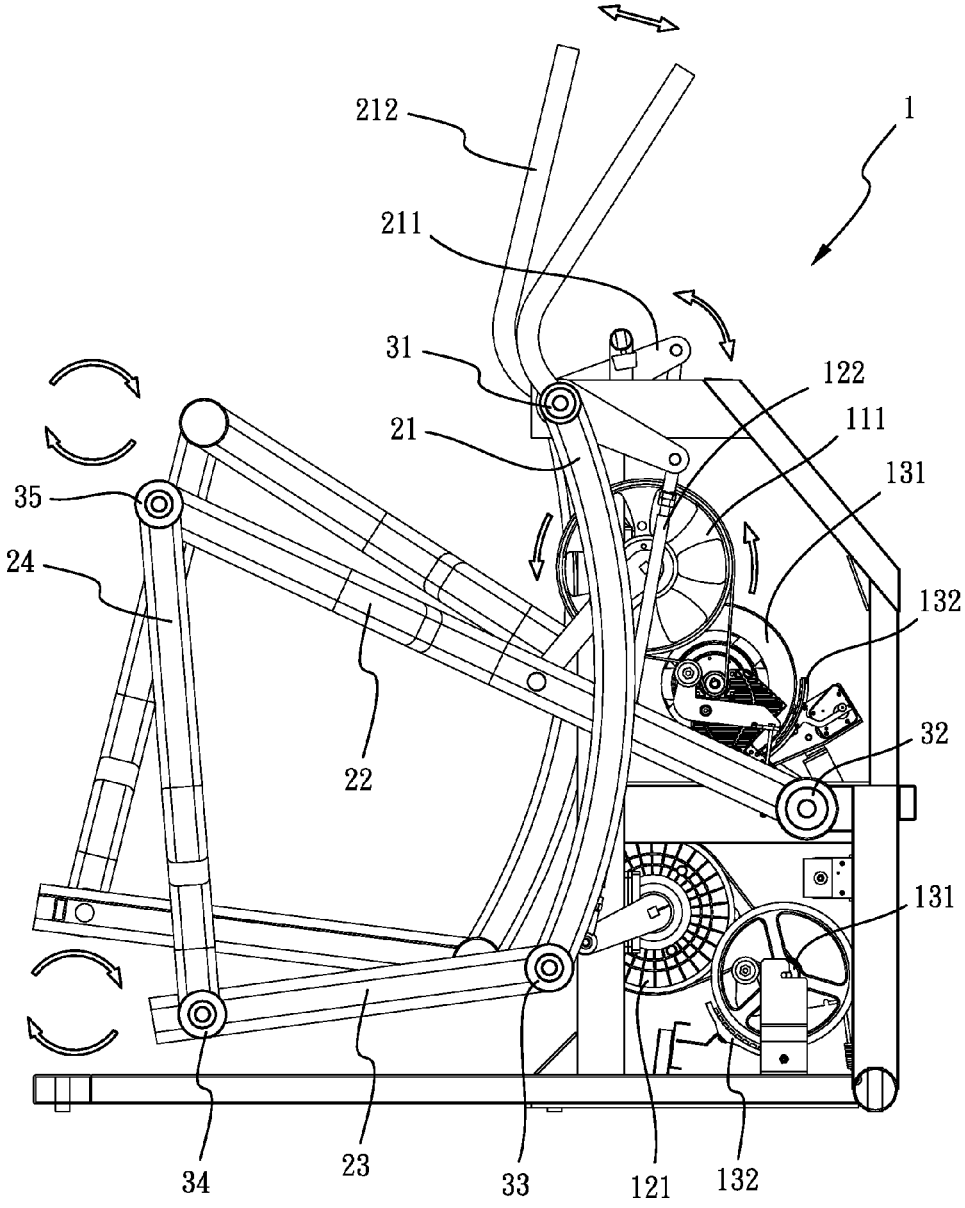
FIG. 6 is an operational view of the multi-mode exercise bike in accordance with the present invention in a circular exercise mode.

Referring FIG. 6, when the user alternatively steps on the pedals 231 along a circular direction, the guiding wheel set 11 guides the second arm 22 reciprocatingly swinging up and down as the pivot of the second jointer 32 such that the third arm 23 is able to be swung up and down. The third arm 23 is also suspensibly swung along the parallel direction as the pivots of the first jointer 31 and the fifth jointer 35 such that the fifth jointer 35 and the third jointer 33 are moved to-and-fro relative to each other to form a circular track of the pedal 231.

Further description as the following, each first arm 21 has a connector 211 extending from the first jointer 31. The main body 1 has a second guiding wheel set 12 mounted therein for guiding the first arm 21 reciprocatingly swinging as the pivot of the first jointer 31. The second guiding wheel set 12 includes a second rotating disc 12 and two second connecting rods 122 respectively connected with two sides of the second rotating disc 121. Each second connecting rod 122 has one end eccentrically pivotally connected with the second rotating disc 121 and the other end pivotally connected with the connector 211.

Figure 2:
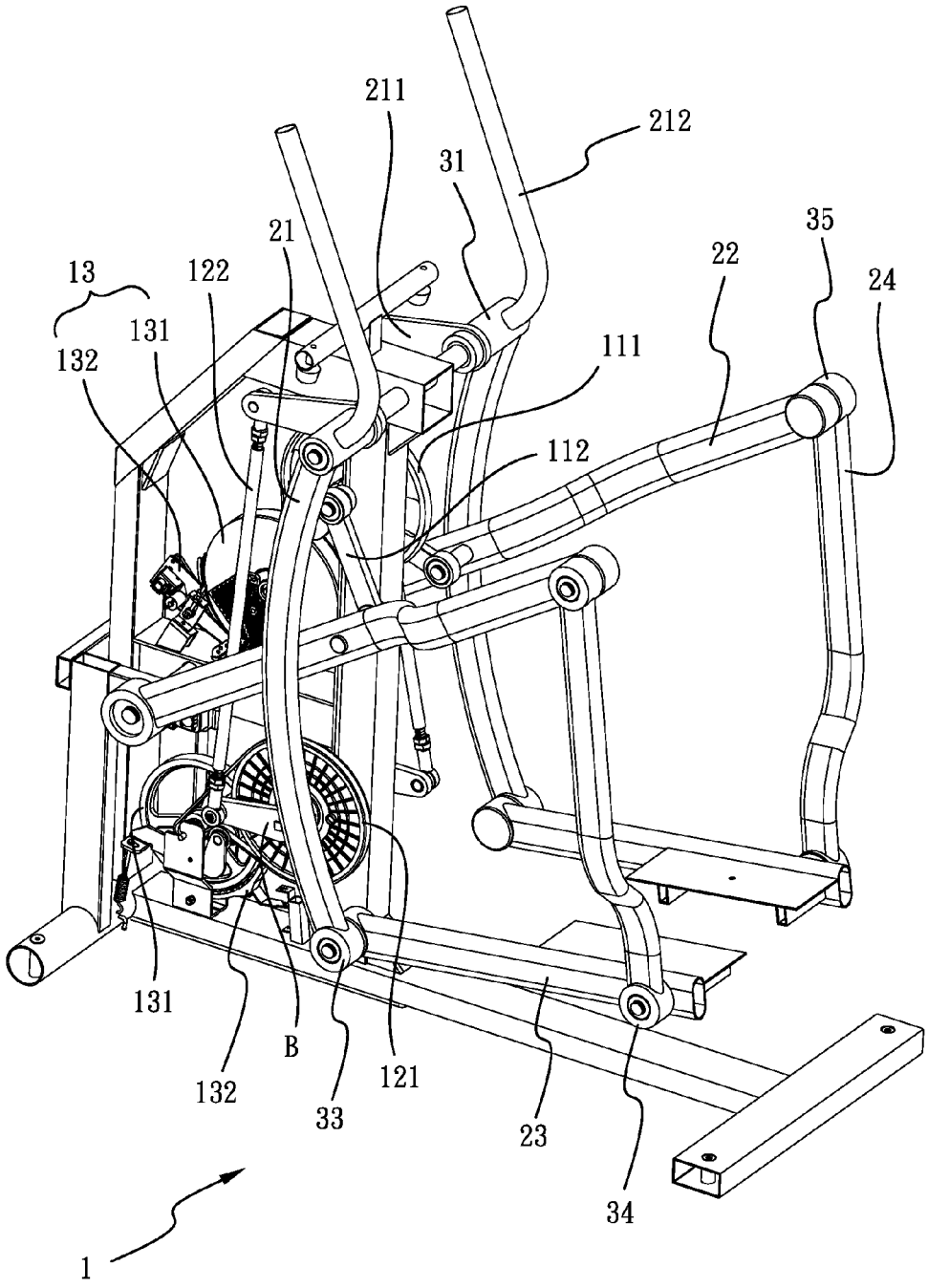
FIG. 2 is a perspective view of the multi-mode exercise bike in accordance with the present invention in another direction.
Figure 3:
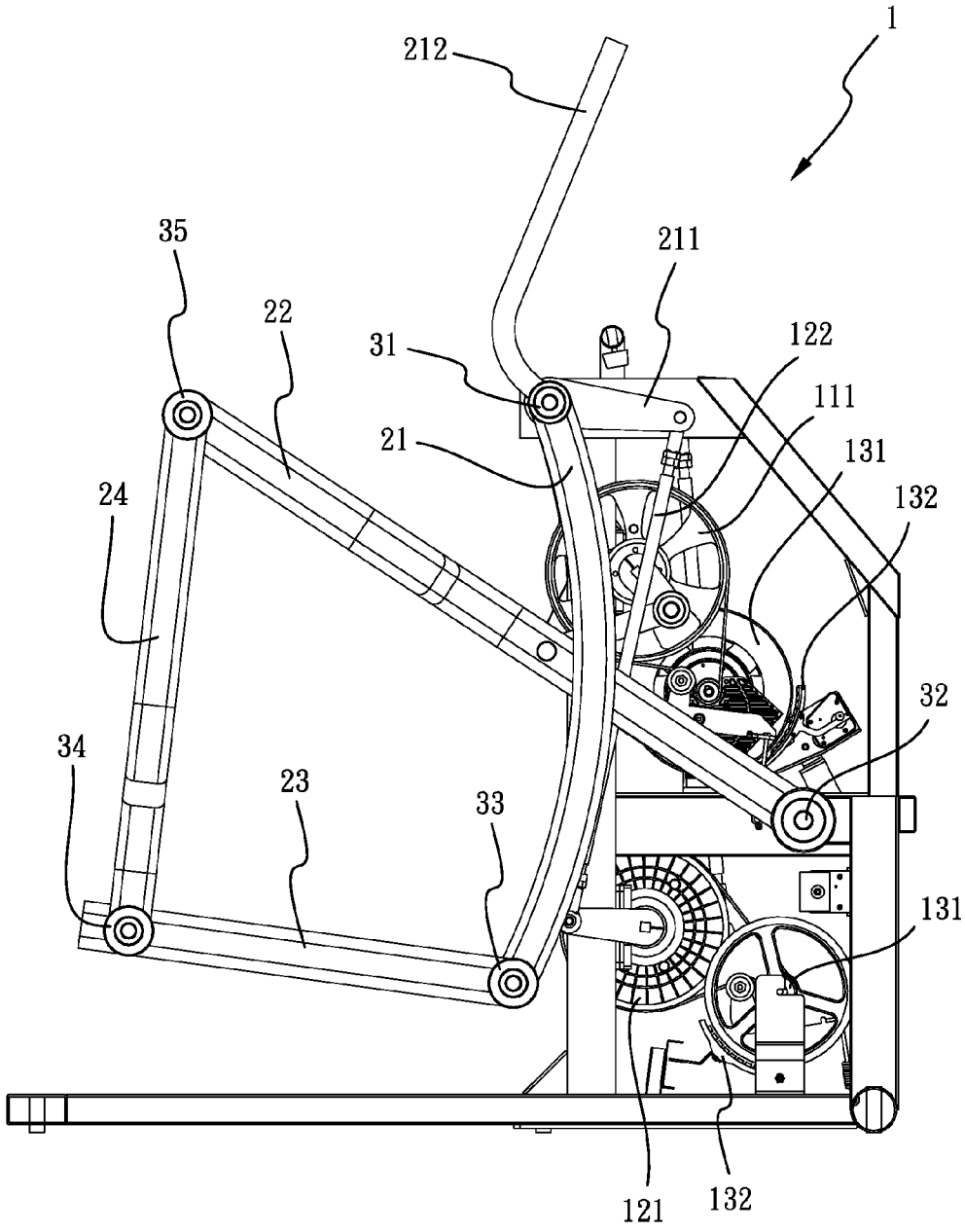
FIG. 3 is a side plan view of the multi-mode exercise bike in accordance with the present invention.

Referring to FIGS. 1-2, the rotating disc 111 and the second rotating disc 121 respectively have a extender A and a extender B radially extending therefrom. Each of the extender A and the extender B is pivotally connected with connecting rod 112 and the second connecting rod 122. The extenders A and B are increased a width of the rotating disc 111 and a width of the second rotating disc 121.

Further, the main body 1 has two set of damping mechanisms 13 respectively relatively connected with the guiding wheel set 11 and the second guiding wheel set 12. Each damping mechanism 13 has a idle wheel 131 connected with the rotating disc 111/second rotating disc 121 and a magnet unit 132 mounted on the idle wheel 131 for controlling a damping force of the idle wheel 131.

Further, the first arm 21 has a handle 212 extending from the first jointer 31. The handle 212 is pivotable as the pivot of the first jointer 31.

Further, the two pedals 231 of the two third arms 23 are faced to each other.

The multi-mode exercise bike in accordance with the present invention is depended on the user's force for providing a vertical directional mode, a parallel directional mode, and a circular directional mode. The three modes are related to human foot. The user can change various exercise modes to prevent from a long time single exercise mode bringing unexciting and tired felling.

Although the invention has been explained in relation to its preferred embodiment, it is to be understood that many other possible modifications and variations can be made without departing from the spirit and scope of the invention as hereinafter claimed.

What is claimed is:

1. A multi-mode exercise device, comprising:

a main body, the main body having two supporting arm assemblies symmetrically mounted on two sides thereof, each supporting arm assembly comprising:

a first arm having one end pivotally connected with the main body, a first pivot joint located between the main body and the first arm;

a second arm having one end pivotally connected with the main body, a second pivot joint located between the main body and the second arm, the second arm and the first arm arranged in a crisscross manner without directly contacting to each other, the second pivot joint positioned lower than the first pivot joint;

a third arm having one end pivotally connected with the other end of the first arm, a third pivot joint located between the third arm and the first arm, the third arm having a pedal mounted thereon;

a fourth arm having one end pivotally connected with the other end of the third arm and the other end, pivotally connected with the other end of the second arm, a fourth pivot joint located between the third arm and the fourth arm, the fourth pivot joint positioned adjacent to the pedal of the third arm, a fifth pivot joint located between the fourth arm and the second arm; and a guiding wheel set mounted on the main body for guiding the second arm swinging as a pivot of the second pivot joint, the guiding wheel set including:

a rotating disc; and two connecting rods respectively connected with two sides of the rotating disc, the two connecting rods respectively connected with the two supporting arm assemblies, each connecting rod having one end eccentrically pivotally connected with the rotating disc and the other end pivotally connected with a middle section of the second arm located between the second pivot joint and the fifth pivot joint;

wherein when a user alternatively steps on the pedals along a vertical direction, the guiding wheel set guiding the second arm reciprocatingly swinging up and down as the pivot of the second pivot joint, the fourth arm pivotally pulling the third arm such that the third arm is swung up and down as the pivot of the third pivot joint;

when the user alternatively steps on the pedals along a parallel direction, the third arm is suspended on the first arm and the fourth arm such that the third arm is swung along the parallel direction as the pivots of the first pivot joint and the fifth pivot joint;

when the user alternatively steps on the pedals along a circular direction, the guiding wheel set guiding the second arm reciprocatingly swinging up and down as the pivot of the second pivot joint such that the third arm is able to be swung up and down, the third arm is also suspensibly swung along the parallel direction as the pivots of the first pivot joint and the fifth pivot joint such that the fifth pivot joint and the third pivot joint are moved to-and-fro relative to each other to form a circular track of the pedal.

2. The multi-mode exercise device as claimed in claim 1, wherein each first arm has a connector extending from the first pivot joint, the main body having a second guiding wheel set mounted therein for guiding the first arm reciprocatingly swinging as the pivot of the first pivot joint, the second guiding wheel set including a second rotating disc and two second connecting rods respectively connected with two sides of the second rotating disc, each second connecting rod having one end eccentrically pivotally connected with the second rotating disc and the other end pivotally connected with the connector.

3. The multi-mode exercise device as claimed in claim 2, wherein the main body has two set of damping mechanisms respectively relatively connected with the guiding wheel set and the second guiding wheel set, each damping mechanism having a idle wheel connected with the rotating disc/second rotating disc and a magnet unit mounted on the idle wheel for controlling a damping force of the idle wheel.

4. The multi-mode exercise device as claimed in claim 1, wherein the first arm has a handle extending from the first pivot joint, the handle being pivotable as the pivot of the first pivot joint.

5. The multi-mode exercise device as claimed in claim 1, wherein the two pedals of the two third arms are faced to each other.

* * * * *